United States Patent [19]

Romagnoli

[11] 4,317,399

[45] Mar. 2, 1982

[54] DIE CUTTER FOR STAMPING RECTANGULAR OBJECTS WITH ROUNDED CORNERS

[75] Inventor: Andrea Romagnoli, San Lazzaro Di Savena, Italy

[73] Assignee: I.M.A. - Industria Macchine Automatiche S.p.A., Ozzano Emilia, Italy

[21] Appl. No.: 157,066

[22] Filed: Jun. 6, 1980

[30] Foreign Application Priority Data

Dec. 14, 1979 [DE] Fed. Rep. of Germany ..... 2950469

[51] Int. Cl.[3] ..... B26F 1/00

[52] U.S. Cl. ..... 83/237; 83/50; 83/686; 83/694; 83/925 R

[58] Field of Search ..... 83/50, 55, 237, 685, 83/686, 694, 925 R; 53/549, 427

[56] References Cited

U.S. PATENT DOCUMENTS 3,490,323 1/1970 Jensen et al. ..... 83/694 X

*Primary Examiner*—James M. Meister

*Attorney, Agent, or Firm*—Karl F. Ross

[57] ABSTRACT

A device designed to stamp generally rectangular blister packages from an intermittently advancing laminated strip comprises a die with rounded corners whose radii of curvature are substantially larger at a transverse leading edge than at a transverse trailing edge as seen in the direction of strip motion. The width of the die slightly exceeds the advance of the strip between cutting operations whereby packages stamped from the strip exhibit obtuse angles but no pointed projections at their forward edges.

5 Claims, 7 Drawing Figures

DIE CUTTER FOR STAMPING RECTANGULAR OBJECTS WITH ROUNDED CORNERS

FIELD OF THE INVENTION

My present invention relates to a device for automatically stamping generally rectangular objects with rounded corners from a strip of sheet material.

BACKGROUND OF THE INVENTION

So-called blister packages are formed from a foil of thermoplastic material, e.g. polyvinylchloride, initially provided with a multiplicity of generally cup-shaped depressions or blisters designed to receive pills or similar articles to be stored. The preformed foil is heat-sealed onto a carrier strip, usually of metal, from which individual packages are subsequently stamped in a die-cutting operation. The packages can then be stacked for assembly in larger containers.

In commonly owned German published specification No. 27 05 293 there has been disclosed a device for stamping such packages from a continuous composite strip consisting of a preformed thermoplastic foil bonded onto an overlying metallic cover layer. The strip is advanced intermittently along a stationary support having a cutout whose outline substantially corresponds to that of the packages to be stamped. After every advance, over a distance corresponding to the dimension of the package in the transport direction, a cutting die having an outline in the shape of a rectangle with rounded corners severs a portion of the strip whose lateral edges project slightly beyond those of the cutout. The severed strip portion, constituting a sealed package, enters the cutout for assembly into a stack of such packages whereupon the die is retracted and the transport mechanism takes another step.

In the ideal case, in which the pitch of the feed means—i.e. the advance of the strip between die-cutting strokes—exactly equals the width of the die in the transport direction, the leading edge of the die registers precisely with the end of the previous cut so that the newly stamped plate has a front edge merging smoothly into its rounded corners. In practice, however, such a precise coincidence is difficult to achieve with any degree of constancy. If the advance of the strip falls short of the width of the die, its leading edge intersects the previously shaped strip boundary in the region of the corners where that boundary has an opposite curvature; as a result, unsightly and potentially dangerous pointed projections are formed near the corners of the front edge of the newly stamped plate. If, on the other hand, the advance exceeds the width of the die, a transverse web of greater or lesser thickness remains wastefully connected with the stamped-out strip.

OBJECT OF THE INVENTION

The object of my invention, therefore, is to provide an improved stamping device for the purpose described which obiates these drawbacks.

SUMMARY OF THE INVENTION

I have found, in accordance with my present invention, that the formation of pointed projections on the front edge of a generally rectangular object stamped from an intermittently advancing strip, e.g. a blister package, can be avoided by giving the die (and therefore the object) a somewhat unsymmetrical configuration, namely quadrantally arcuate corners of relatively small radius at junctions of its transverse trailing edge with its longitudinal edges and quadrantally arcuate corners of relatively large radius at junctions of its transverse leading edge with its longitudinal edges, the associated feed means advancing the strip between cutting strokes by a pitch which is slightly less than the spacing of the leading and trailing edges of the die. The terms "leading", "trailing", "longitudinal" and "transverse" are all referred to the direction of strip motion and are independent of the relative dimensions of the rectangle.

With proper choice of the ratio of the two radii of curvature, and to the extent by which the spacing of the transverse die edges exceeds the pitch of the strip feed, the leading edge of the die will intersect the previously cut strip boundary at points where that boundary is straight rather than inversely curved, thus replacing the aforementioned pointed projections by harmless obtuse angles. That excess, in any event, should be less than the difference between the large and small radii of curvature; the ratio of these radii advantageously ranges between about 1.5 and 2.

BRIEF DESCRIPTION OF THE DRAWING

The above and other features of my invention will now be described in detail with reference to the accompanying drawing in which.

SPECIFIC DESCRIPTION

Figure 1:
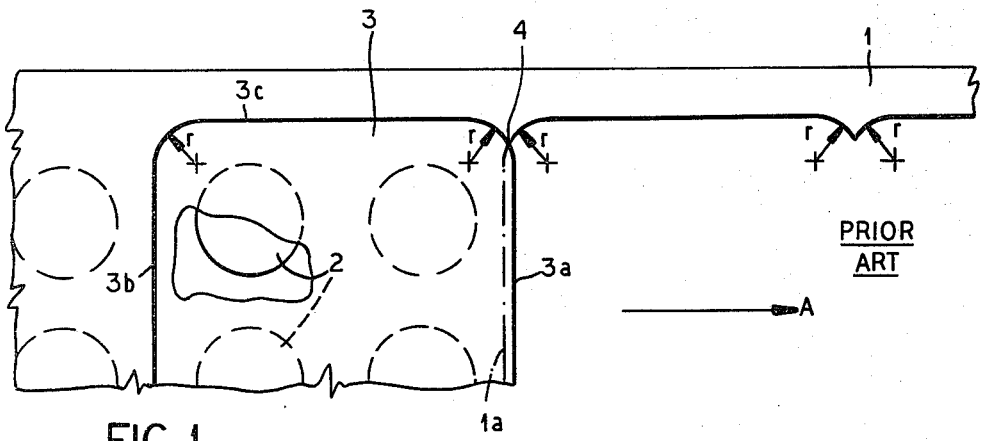
FIG. 1 is a fragmentary plan view of a conventional die for cutting blister packages from a composite strip advancing with a pitch shorter than the width of the die.
Figure 2:
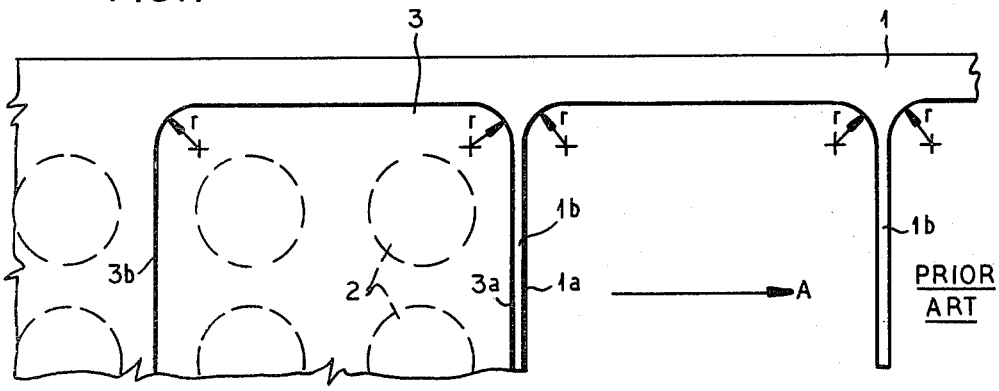
FIG. 2 is a view similar to FIG. 1 but illustrating a pitch which exceeds the width of the same conventional die.

In FIGS. 1 and 2 I have shown part of a composite strip 1, laminated from a metallic layer 1' and a PVC foil 1'' (see FIG. 7) formed with blisters 2, from which packages of rectangular outline—but with rounded corners—are to be cut by a conventional die 3. This die, visible only in part, has a leading edge **3*a* and a trailing edge 3*b* (as viewed in the direction of advance A of strip 1) as well as two longitudinal edges 3*c*** (only one shown). All four junctions of these edges are arcuately shaped as quadrants of a circle with identical radii of curvature r.

Figure 4:
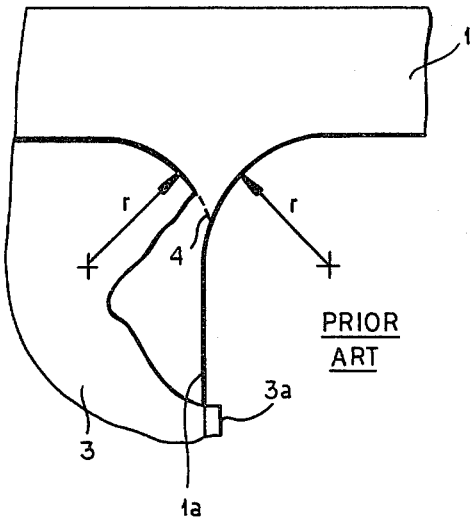
FIG. 4 shows an enlarged segment of the strip and part of the die of FIG. 1.

In FIG. 1 a line **1*a* represents the boundary of strip 1 resulting from a preceding cutting stroke of die 3. The distance between edge 3*b* and boundary 1*a* represents the pitch of the strip motion, i.e. the extent of its advance between cutting strokes, and is seen to be somewhat less than the width of the die as measured between its transverse edges 3*a* and 3*b*. As a result of this difference, edge 3*a* intersects boundary 1*a* on the next cutting stroke at a point 4 (as well as at a symmetrical point in the nonillustrated part of the strip) and forms a sharp projection as best seen in FIG. 4**. These pointed projections could damage adjoining packages or injure a user.

FIG. 2 illustrates the situation existing when the pitch of strip motion, again measured between boundary 1*a* and die edge 3*b*, exceeds the width of the die in the transport direction A. In this instance the strip 1 is left with transverse webs 1*b* of unused material going to waste.

Figure 3:
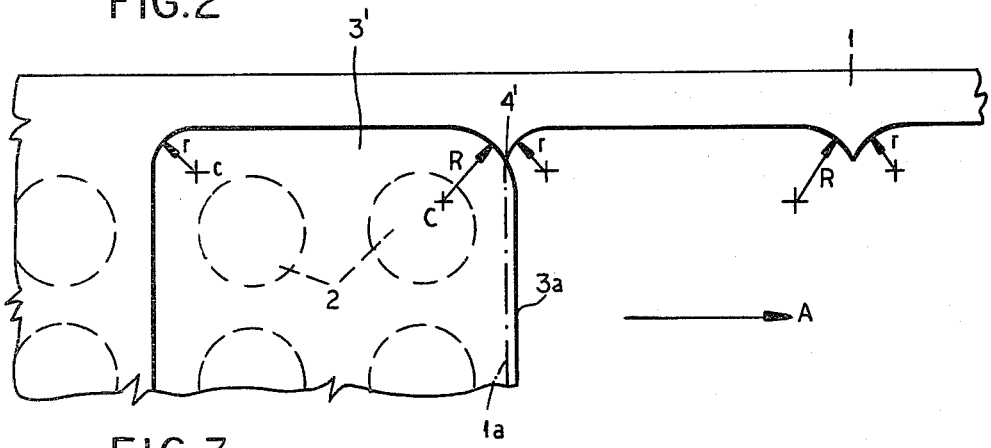
FIG. 3 is another view similar to FIG. 1 but showing my improved die with a width exceeding the pitch of the strip motion.

In FIG. 3 I have illustrated a modified die 3' which, in accordance with my present improvement, has its transverse leading edge 3*a* merging into its longitudinal edges 3*c* along quadrantal arcs with centers C (only one shown) whose radius of curvature R substantially exceeds the radius r of the rounded corners at the trailing edge 3*b* having centers c. Thanks to this difference in radius, the intersection between cutting edge 3*a* and strip boundary 1*a* at a point 4' (and, again, at a nonillustrated symmetrical point at the opposite corner) forms an obtuse angle as best seen in FIG. 5, in contrast to the sharp projection at point 4 shown in FIGs. 1 and 4.

Strip 1 is longitudinally divided into a multiplicity of sections of identical width to be severed therefrom as individual packages. Each section contains two rows of blisters 2 and, as further illustrated in FIG. 5, is bisected by a transverse centerline M which, in the cutting position with strip 1 standing still, is separated from the leading die edge 3*a* by a distance a and from the trailing die edge 3*b* by a shorter distance b. FIG. 5 depicts a limiting case in which strip 1 is advanced with a pitch 2*b*, equal to the width of a section, so chosen that the intersection 4' is aligned in the direction of advance with the center of curvature c of the rear corner of radius r whereby the point 4' comes to lie at the end of the straight section of strip boundary 1*a*. In practice, the distance d between boundary 1*a* and cutting edge 3*a* may vary between a−b and zero. In the other limiting case of d=0, the obtuse angle at point 4' would disappear. The maximum value of distance d, representing the excess of the die width a+b over the width 2*b* of a strip section, is given by $r-\sqrt{r(2R-r)}$ and must always be less than R−r.

Figure 6:
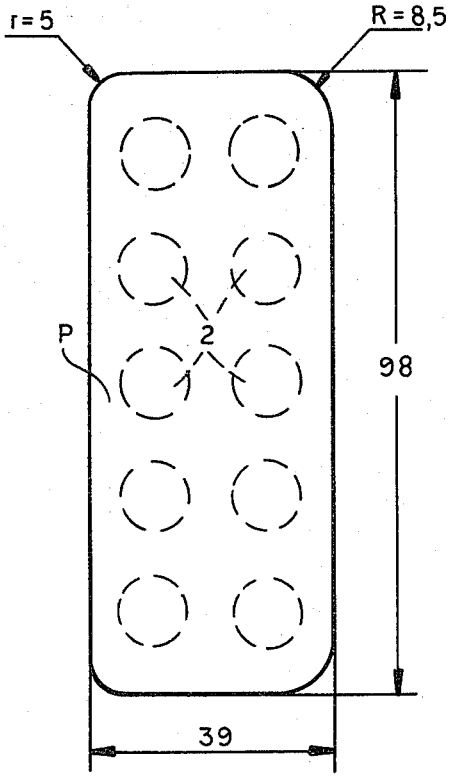
FIG. 6 is a face view of a blister package cut with the die of FIGS. 3 and 5.

In FIG. 6 I have illustrated a complete package P with ten blisters whose dimensions, e.g. in millimeters, are a width of 39, a height of 98, a rear radius of curvature r=5 and a front radius of curvature R=8.5. In this instance, therefore, the ratio R:r is 1.7.

Figure 7:
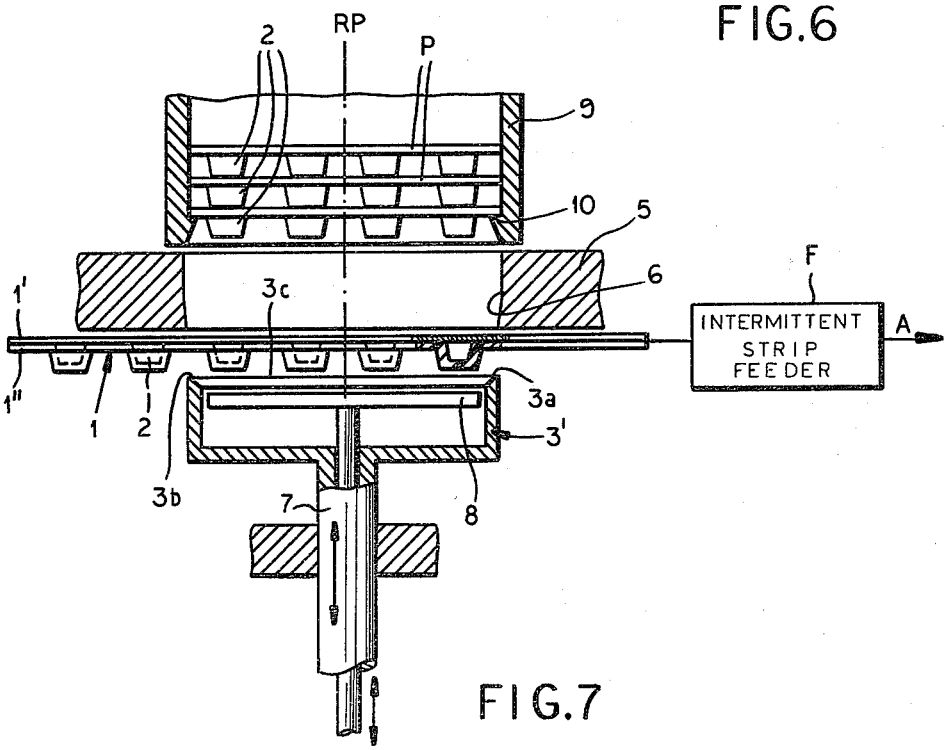
FIG. 7 is a somewhat diagrammatic cross-sectional view of a device for stamping blister packages with a die according to my invention.
Figure 5:
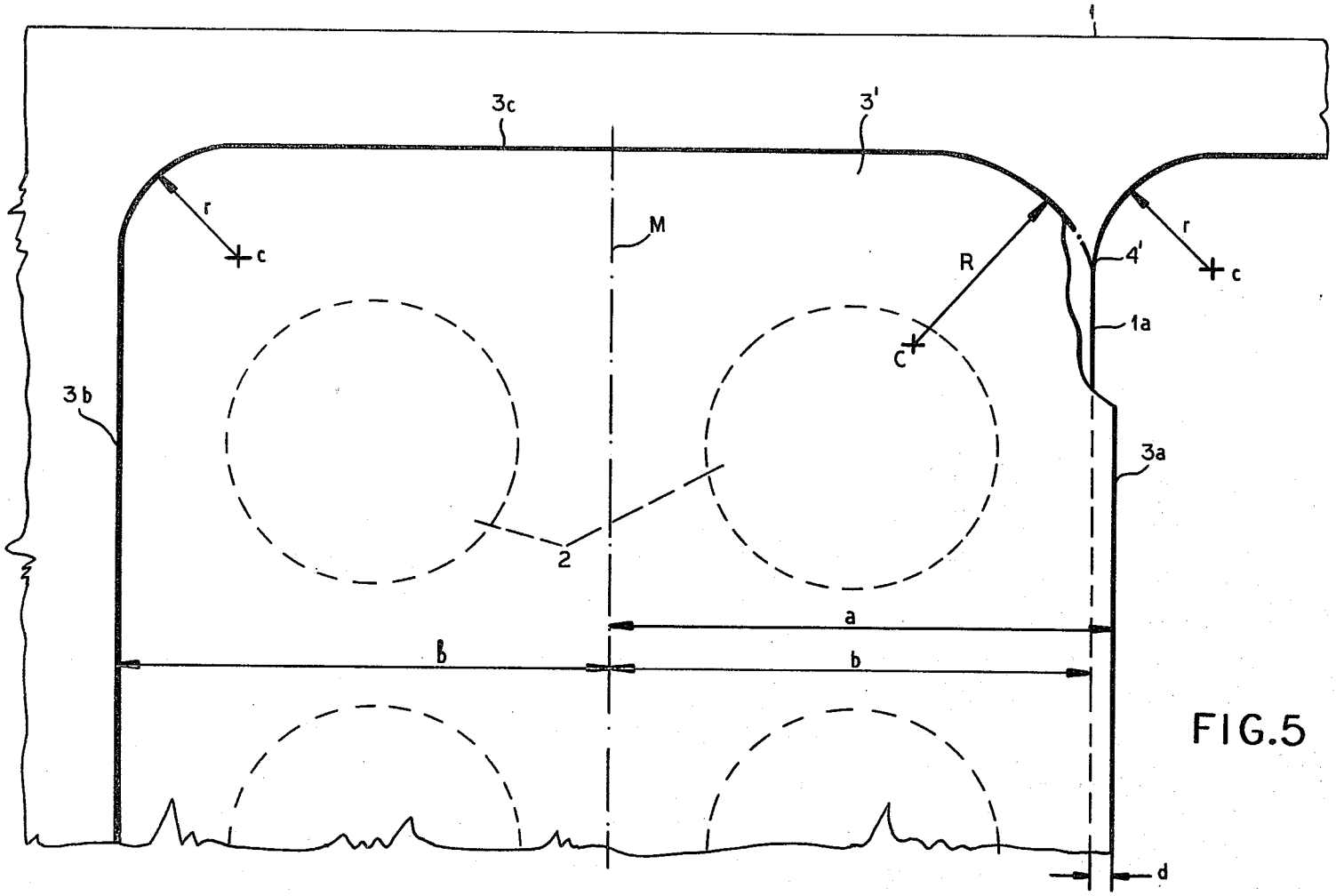
FIG. 5 is an enlarged view of the parts of FIG. 3 drawn to the same scale as FIG. 4.

It will be apparent that more than one row of blisters may lie on each side of the centerline M shown in FIG. 5. FIG. 7, in fact, illustrates a die cutter designed to stamp packages with two such rows on each side of a reference plane RP of die 3' including that centerline; because of the dissymmetry of the die, plane RP lies only approximately midway between cuting edges 3*a* and 3*b*. The device of FIG. 7 corresponds, aside from the unsymmetrical die 3', to the one disclosed in the commonly owned German published specification No. 27 05 293 referred to above. Die 3' is integral with a piston rod 7 which is part of a mechanism, not further illustrated, synchronized with the intermittent drive for the strip 1 (symbolized by arrow A) so as to rise on standstill of the strip into a generally rectangular cutout 6 of a supporting or backing frame 5. A pusher 8 inside die 3' is independently displaceable, after entry of the die into cutout 6, to elevate the newly severed package P into a stacking magazine 9 which is provided near its bottom with internal shoulders 10 that can be elastically cleared by the package but prevent its subsequent descent. The articles contained in blisters 2 have not been illustrated.

It will be apparent that my invention is generally applicable to plate-shaped objects other than blister packages to be die-cut from a continuous strip of sheet material with or without distinctively preformed sections.

I claim:

1. A device for stamping generally rectangular objects from a strip of sheet material, comprising:

a support having a cutout of generally rectangular shape;

feed means for intermittently advancing a strip to be cut along said support with lateral edges slightly projecting beyond said cutout; and a generally rectangular die synchronized with said feed means confronting said cutout for periodically cutting an object from the advancing strip during periods of standstill thereof, said die having quadrantly arcuate corners of relatively small radius at junctions of a transverse trailing edge with a pair of longitudinal edges and further having quadrantally arcuate corners of relatively large radius at junctions of a transverse leading edge with said longitudinal edges, said feed means advancing said strip between cutting strokes of said die by a pitch slightly less than the spacing of said leading and trailing edges.

2. A device as defined in claim 1 wherein the pitch of said feed means substantially equals the distance between transverse centerlines bisecting preshaped sections into which said strip is longitudinally divided, said feed means being operable to arrest said strip preparatorily to a cutting stroke in a position in which one of said centerlines coincides with a reference plane lying generally midway between said leading and trailing edges, said reference plane being separated from said trailing edge by substantially half said pitch.

3. A device as defined in claim 1 or 2 wherein the excess of said spacing over said pitch is less than the difference between said large and said small radius.

4. A device as defined in claim 3 wherein said large radius range between substantially 1.5 and 2 times said small radius.

5. A device as defined in claim 3 wherein said excess has a maximum value substantially corresponding to a position in which said leading edge intersects a previously cut strip boundary along a straight-line portion of said boundary.

* * * * *